United States Patent [19]

Rear

[11] Patent Number: 4,530,407

[45] Date of Patent: Jul. 23, 1985

[54] FLUID OPERATED HAMMER

[76] Inventor: Ian G. Rear, 53 Louise St., Nedlands, Australia

[21] Appl. No.: 302,999

[22] Filed: Sep. 17, 1981

[51] Int. Cl.[3] ..... E21B 1/06

[52] U.S. Cl. ..... 173/17; 173/73; 173/137

[58] Field of Search ..... 173/16, 17, 14, 137, 173/116, 133, 128, 138, DIG. 4; 91/234; 92/85 B; 175/92

[56] References Cited

U.S. PATENT DOCUMENTS

| | | | |
|---|---|---|---|
| 2,887,989 | 5/1959 | Dulaney | 91/234 |
| 4,084,646 | 4/1978 | Kurt | 173/17 |
| 4,312,412 | 1/1982 | Pillow | 173/17 |
| 4,333,537 | 6/1982 | Harris et al. | 173/17 |

FOREIGN PATENT DOCUMENTS

| | | | |
|---|---|---|---|
| 2155540 | 5/1973 | Fed. Rep. of Germany | 175/92 |
| 1552975 | 9/1979 | United Kingdom | 173/17 |

*Primary Examiner*—Frank T. Yost
*Assistant Examiner*—Hien H. Phan
*Attorney, Agent, or Firm*—Harness, Dickey & Pierce

[57] ABSTRACT

A fluid operated hammer comprising; a casing; a top sub mounted to one end of the casing; a drill bit mounted to the other end of the casing; a feed tube located concentrically within the casing and extending for a portion of the length of the casing from said one end; and a piston slidably mounted in the casing for longitudinal movement between the top sub and drill bit over the feed tube; the feed tube being formed with at least one elongate aperture wherein the longitudinal dimensions of the at least one aperture correspond to a significant proportion of the degree of reciprocation of the piston; a first passageway provided in the piston and extending between the central bore and the external face thereof to provide a communication between the at least one aperture and the space between the piston and the top sub when the piston is at or near the top sub and for a significant proportion of the degree of movement of the piston from the top sub to a drive the piston towards the other end of the casing; a rebate formed in the internal face of the casing adjacent or near the other end; and a second passageway in the piston and extending from the central bore thereof to the external face thereof to provide communication between the at least one aperture and the rebate when the piston is abutting the drill bit to admit fluid into the space between the piston and drill bit and drive the piston towards the one end.

8 Claims, 12 Drawing Figures

FLUID OPERATED HAMMER

BACKGROUND OF THE INVENTION

This invention relates to a fluid operated hammer used in drill bore holes and the like.

Throughout this specification, the term "upper" when used in relation to a hammer shall refer to that end of the hammer adjacent the top sub and the term "lower" when used in relation to a hammer shall relate to that end of the hammer adjacent the drill bit.

In fluid operated hammers currently in use, fluid is supplied to the hammer to cause reciprocation of the piston through ports and passageways formed in the casing. As a result of wear in the casing caused by the reciprocation of the piston within the casing such hammers rapidly lose their efficiency due to the increase in the area of the annulus separating the piston and the casing. In addition, the manufacture of such hammers is difficult due to the necessity to provide the passageways through the walls of the casing. Furthermore, due to the presence of the passageways in the walls of the casing the internal cross-section area available within the casing for the piston is reduced, as a result the pressure area and the mass of the piston is reduced and the potential effectiveness of the hammer is reduced.

It is an object of this invention to provide a fluid operated hammer not requiring passageways in the walls of the casing for delivery of fluid to the piston.

In other fluid operated hammers which utilise an axial feed tube to apply fluid to both the drill bit and the reciprocating piston the supply of fluid to effect reciprocation of the piston is for a single relatively short period at either end of the travel of the piston. As a result the downward thrust exerted on the piston is produced by gravity when the hammer is used for holes extending downwardly and the pressure applied by the fluid injected into the space above the piston when it is at its uppermost position.

It is an object of this invention to provide for the injection of fluid into the space above the piston for a significant proportion of the degree downward movement of the piston within the hammer.

In one form the invention resides in a fluid operated hammer comprising; a casing; a top sub mounted to one end of the casing; a drill bit mounted to the other end of the casing; a feed tube located concentrically within the casing and extending for a portion of the length of the casing from said one end; and a piston slidably mounted in the casing for longitudinal movement between the top sub and drill bit over said feed tube; said feed tube being formed with at least one elongate aperture wherein the longitudinal dimensions of said at least one aperture correspond to a significant proportion of the degree of reciprocation of said piston; a first passageway provided in the piston and extending between the central bore and the external face thereof to provide a communication between the said at least one aperture and the space between the piston and the top sub when the piston is at or near the top sub and for a significant proportion of the degree of movement of the piston from the top sub to a drive the piston towards the other end of the casing; a rebate formed in the internal face of the casing adjacent or near the other end; and a second passageway in the piston and extending from the central bore thereof to the external face thereof to provide communication between said at least one aperture and said rebate when said piston is abutting said drill bit to admit fluid into the space between the piston and drill bit and drive the piston towards the one end.

According to a preferred feature of the invention the feed tube is mounted to and located in the one end of the casing bore and is isolated from the top sub to ensure that the piston and feed tube are concentric to one another within the casing.

According to a further preferred feature the at least one aperture comprises a set of longitudinally spaced apertures.

According to another preferred feature of the invention the at least one aperture comprises an axial elongate slot formed in the wall of the feed tube.

According to a further preferred feature the internal face of the casing and the external face of the piston adjacent the top sub are each formed with an annular rib wherein said ribs engage each other at an intermediate position in the degree of travel of the piston to close communication via said first port between the at least one aperture and the space between the top sub and the adjacent end of the piston.

According to a preferred feature of the last mentioned feature the annular rib in the casing is provided by a sleeve located with the casing.

According to a further preferred feature, the feed tube can be replaced with another of differing characteristics to vary the periodicity of communication of fluids between the ends of the piston.

According to a further preferred feature of the invention the feed tube is mounted in the casing via a spacer and centralising ring wherein said ring is capable of being replaced by a ring of differing dimensions to vary the volume of the chamber between the piston and the top sub.

According to another preferred feature the drill bit is capable of limited longitudinal slidable movement in the casing and is retained in the casing via a bit retaining ring located on the internal face of the casing and a rib on the external face of the drill bit, said ribs being engaged when the bit occupies the extended position in the casing and wherein an annular member of resilient shock absorbing material is incorporated in said bit retaining ring to absorb some of the shocks imposed thereon by the bit.

In existing hammers, it has been known for such hammers to prematurely fail due to excessive wear of the casing and/or feed tube and/or piston. One major cause of such excessive wear has been the misalignment of the feed tube within the bore of the casing. It is current practice in at least one form of hammer to mount the feed tube of the hammer into the top sub of the hammer which is then threadably mounted into the casing. Alternatively it is common practice to locate the feed tube in a counter-bored portion at one end of the casing. In such circumstances, to ensure that the feed tube is aligned concentrically within the bore of the casing on assembly of the hammer, involves precise machining of the feed tube, casing, counter-bore, casing thread, top sub and top sub thread and ring stringent quality control.

It is an object of this invention to reduce the degree of precise machining of components of fluid operated hammers.

In another form the invention resides in a fluid operated hammer comprising a casing having a drill bit mounted to one end and a top sub mounted to the other end, a feed tube mounted concentrically within the casing and a piston longitudinally slidable within the casing between the drill bit and the top sub over the feed tube, wherein the feed tube is mounted and located in the one end of the casing and is isolated from the top sub.

SUMMARY OF THE INVENTION

According to a preferred feature of the last mentioned form of the invention the feed tube is mounted in the casing via a spacing and centralising ring wherein said ring is capable of being replaced by a ring of differing dimensions to vary the volume of the chamber between the piston and the top sub.

According to a further preferred feature of the last mentioned form of the above invention, the feed tube can be replaced with another of differing characteristics to vary the periodicity of the communication fluids between the ends of the piston.

With fluid operated hammers in use when the hammer is placed in the "blow-down" position in which the hammer is inoperative and the anvil of the drill bit is in contact with the bit retaining ring there can often be failure of the bit retaining ring or the portion of the drill bit engaged by the bit retaining ring. This is due to the anvil being impacted by the piston of the hammer when the drill bit first moves to the "blow-down" position or due to "back hammering" occuring, when the hammer is in the "blow-down" position. In some cases, it has been known for hammers to fail regularly when such hammers are involved in normal operational use. Such failure not only causes considerable delay in drilling operations but is expensive and requires an operator to maintain a large supply of spare parts for such hammers and can in some instances results in the abandonment of the drill hole when the failed components cannot be retrieved or withdrawn from the drill hole.

It is an object of this invention to absorb some of the shock forces exerted on the bit retaining ring when the hammer is in the "blow-down" position caused by the drill bit being impacted by the piston to reduce the possibility of failure of the drill bit or bit retaining ring in the course of normal operations.

In another form the invention resides in a fluid operated hammer comprising a casing; a drill bit mounted to one end of the casing; a top sub mounted to the other end of the casing; and a piston longitudinally slidably mounted within the casing wherein said drill bit is longitudinally slidable within the casing and is retained therein via an annular bit retaining ring located on the internal face of the casing and a rib on the external face of the drill bit; said bit retaining ring and said rib being engaged when the bit occupies the extended position in the casing; and wherein an annular member of resilient shock absorbing material is incorporated in said bit retaining ring to absorb some of the shock imposed thereon by the bit between said ribs.

In another form the invention resides in a fluid operated hammer comprising; a casing; a top sub mounted to one end of the casing; a drill bit mounted to the other end of the casing; a feed tube located concentrically within the casing and extending from said one end for a portion of the length of the casing; and a piston slidably mounted in the casing for longitudinal movement between the top sub and the drill bit over said feed tube; said feed tube being formed with one elongate aperture having its longitudinal axis parallel with the longitudinal axis of the feed tube; the portion of the piston adjacent said top sub being of reduced diameter; a first annular rib formed on the reduced diameter portion of the piston; a second annular rib formed on the internal face of the casing which is intended to slidingly and sealingly engage said first rib at an intermediate position in the piston; to define a reservoir space between the external cylindrical face of the reduced diameter portion of the piston and the internal face of the casing; a first passageway interconnecting the internal bore of the portion and the external face of the reduced diameter portion of the piston wherein when at said intermediate position fluid from said aperture is admitted to said reservoir space and on movement of the piston to said top sub said reservoir space opens into the space between the top sub and the adjacent end of the piston; and a second passageway interconnecting the internal bore of the piston with the external face of the piston to provide communication between the aperture and the space between the drill bit and the adjacent end of the piston when the piston is closely adjacent said drill bit.

According to a preferred feature of the invention the second annular rib is formed on the internal face of a sleeve located within the casing.

The invention will be more fully understood in the light of the following description of two specific embodiments. The description is made with reference to the accompanying drawings in which;

BRIEF DESCRIPTION OF THE DRAWINGS

FIGS. 5, 6 and 7 are sectional side elevations of a fluid operated hammer according to the second embodiment showing the piston in the raised position, impact position, and "blow-down" position respectively.

DETAILED DESCRIPTION OF THE PREFERRED EMBODIMENTS OF THE INVENTION

Figure 1:
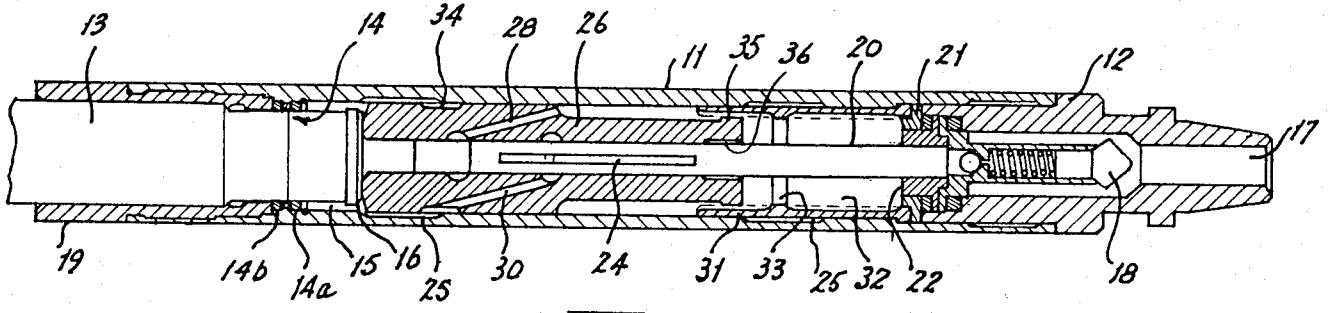
FIG. 1 is a sectional side elevation of a fluid operated hammer according to the first embodiment showing the piston in its impact position with the drill bit.

The first embodiment of FIGS. 1, 2, 3 and 4 is directed towards a fluid operated hammer which comprises a cylindrical casing 11 having a top sub 12 mounted at one end and a drill bit 13 mounted at the other end. The drill bit 13 is mounted within a drill chuck 19 which is threadably engaged in the other end of the casing. The drill bit 13 is longitudinally slidable within the chuck for a limited degree of travel therein. Such limited slidable movement of the drill bit 13 is facilitated by a bit retaining ring 14 mounted in the inner end of the chuck which is received within a waisted portion 15 at the innermost end of the drill bit. The innermost end of the drill bit 13 which extends beyond the bit retaining ring 14 is formed with an expanded portion which serves as an anvil 16. The anvil 16 is intended to engage with the bit ring 14 when the hammer is raised from the bottom of a bore hole to permit the drill bit to drop to its lowermost position in the hammer and thus permit fluid "blow-down" into the bore hole.

The bit ring 14 comprises an annular ring **14*a* which is separated from the inner end of the drill chuck 19 by an annular ring 14*b* formed of a resilient material such as rubber, neoprene or like materials which is capable of absorbing some shock forces. The resilient ring 14*b* is intended to absorb some of the shock forces which may be exerted on the bit ring by the piston 26 of the hammer striking the anvil 16 when the drill bit is in the "blow-down" position to assist in preventing excessive fatigue in the drill bit when the anvil 16 impinges on the drill bit retaining ring 14**.

The top sub 12 is threadably engaged in the one end of the casing 11 and is provided with a fluid port 17 which communicates with a spring loaded check valve 18 located within the top sub to prevent any reverse fluid flow.

The casing 11 also supports a feed tube 20 which is concentrically mounted at the one end of the casing in abutting relationship with the inner end of the top sub 12. The feed tube 20 extends from the one end of the casing for a portion of the length of the casing and the mounting of the feed tube comprises a centralising spacer ring 21 which is retained in the one end of the casing 11 by virtue of abutting shoulders formed on the internal surface of the casing 11 and the external surface of the spacer ring 21 and by suitable keys. The centralising spacer ring 21 receives a flanged portion 22 of the feed tube provided at the one end of the feed tube and thus retains the feed tube such that it is accurately retained concentrically within the casing 11. The flanged portion 22 of the feed tube extends beyond the centralising spacer ring 21 to be located within a suitably shaped recess formed within the top sub 12. Suitable tolerances are provided between the top sub 12 and flanged end of the feed tube in order that any mis-alignment of the top sub will not effect the alignment of the feed tube 20. Suitable sealing means in the form of O-rings are provided between; the centralising spacer ring 21, the top sub, the flanged end of the feed tube 22 and the centralising spacer ring 14; and the flanged end of the feed tube 22, and the top sub 12; to prevent any loss of fluid from the junctions therebetween and allow some movement of the feed tube in the event that any particles of foreign matter which may be introduced into the fluid so as not to cause the hammer to jam. The centralising spacer ring 21 provides an improved method of locating and centralising the feed tube concentrically within the casing 11 and the piston 26 over previously used methods which have located the feed tube in the lower end of the top sub.

The centralising spacer ring 21 may be readily exchanged with other rings of differing thickness in order that the volume of the space between the upper end piston 26 and the top sub 12 may be varied.

The other end of the feed tube can be provided with a suitably dimensioned choke (not shown) which permits a controlled continuous flow of fluid down through the drill bit 13. The walls of the feed tube are formed with an elongate aperture 24 the main axis of which is substantially parallel with the longitudinal axis of the hammer.

The piston 26 is slidably mounted within the casing 11 to be movable between the top sub 12 and the drill bit 13 over the feed tube 20. The casing 11 is symmetrical about its central transverse plane and is provided towards each end with an annular recess 25. An annular cylindrical sleeve 31 is located within the one end of the casing 11 and extends for a portion of the length thereof such that it extends over the adjacent upper recess 25 formed in the internal walls of the casing 11. The internal face of the cylindrical sleeve 31 is formed with a set of elongate grooves 32 which extend substantially the full length of the sleeve but are interrupted for a portion of their length by a rib 33 which acts as a seal.

The piston 26 is formed with a lower portion which has a diameter conforming to that of the casing 11 such that it is sealingly and slidably engaged by the internal face of the casing 11 while the upper portion of the piston 26 is of a reduced diameter which is less than the diameter of the cylindrical sleeve 31 in order that the upper portion of the piston may be received within the sleeve 31. The uppermost end of the piston 26 is formed with an annular rib 35 the diameter of which conforms substantially with the inner diameter of the cylindrical sleeve 31 such that it slidably and sealingly engages with the internal face of the sleeve 31 and with the rib 33 formed in the grooves of the sleeve. A first passageway 28 is formed in the piston 26 between the internal bore thereof and the upper reduced diameter portion of the piston to provide fluid communication between the aperture 24 and the space defined between the external cylindrical face of the upper portion of the piston 26 and the side walls of the casing 11 and cylindrical sleeve 31 when the first passageway is located adjacent the aperture 24 in the feed tube 20. The lower portion of the piston 26 is formed with an annular recess 34 which communicates with the annular recess 25 formed in the inner face of the casing 11 adjacent the drill bit 13 when the piston is located toward the drill bit end of the hammer. The annular recess 34 in the piston 26 communicates with the inner bore of the piston via a second passageway 30 to provide fluid communication between the aperture 24 of the feed tube 20 and the space defined between the lower end of the piston 26 and the drill bit 13.

Figure 3:
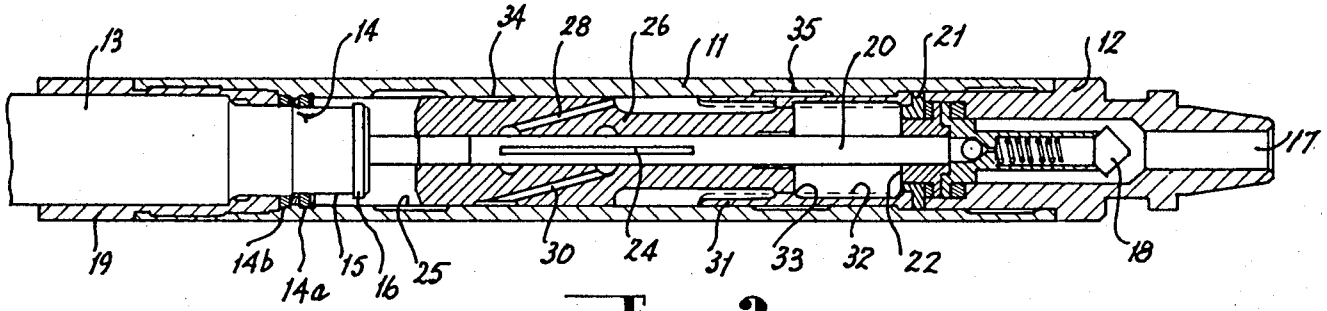
FIG. 3 is a sectional side elevation of the fluid operated hammer of FIG. 1 showing the piston in an intermediate position between the raised position and impact position.

As shown at FIG. 1, when the drill bit 13 is in the raised position within the drill chuck 19 and the piston 26 is at a lower position within the hammer and in engagement with the anvil 16, the second passageway 30 is in communication with the aperture 24 in the feed tube 20 such that high pressure fluid enters the space between the lower end of the piston 26 and the drill bit 13 through the casing recesses 25. As a result the piston 26 is driven upwards towards the top sub 12. The duration of the injection of fluid into the space below the lower end of the piston is limited to a short portion of the pistons initial upward movement since during such upward movement, the second passageway 30 breaks from its communication with the lower space due to the separation of the recesses 25 and 34 formed in the casing 11 and the piston 26 respectively. In addition the first passageway 28 is brought into communication with the aperture 24 in the feed tube 20 and permits the admission of high pressure fluid into space between the external cylindrical face of the upper end of the piston 26 and the internal face of the casing 11 and the cylindrical sleeve. However (as shown in FIG. 3) when the fluid is first admitted to the upper end of the piston 26 via the first port 28, the annular rib 35 formed at the upper end of the piston 26 is in sealing engagement with the ribs 33 which are provided within the grooves 32 in the sleeve 31. Therefore the high pressure fluid from the aperture 24 is contained within the space defined between the external cylindrical face of the upper portion of the piston 26 and the internal face of the casing 11 and sleeve 31 and only a limited downward thrust is exerted on the piston on the area of the annular junction between the upper and lower portions of the piston. With further upward movement of the piston 26 the rib formed at the upper end of the piston 26 disengages from the rib 33 formed in the sleeve 31 such that the high pressure fluid contained in the space between the cylindrical face of the upper portion of the piston and the casing is admitted to the space between the upper end of the piston 26 and the top sub 12 to assist in the deceleration of the piston in its further upward movement.

Figure 2:
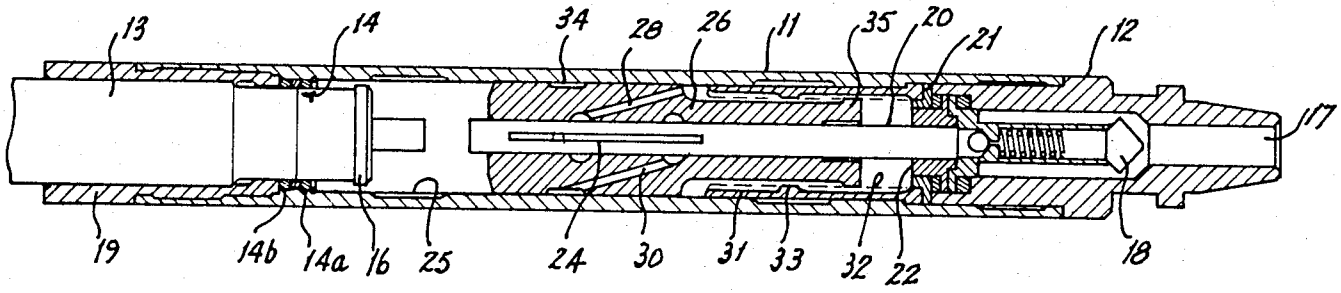
FIG. 2 is a sectional side elevation of the fluid operated hammer of FIG. 1 showing the piston in the raised position.

On the piston reaching the upper end of its stroke (as shown in FIG. 2), high pressure fluid which is admitted into the space between the upper end of the piston 26 and the top sub 12 through the first passageway 28 and the groove 32 formed in the sleeve 31 produces a downward thrust on the piston 26 to drive it towards the drill bit 13. Such downward thrust is exerted on the piston for a significant proportion of the downward travel of the piston while the first passageway 28 is in communication with the slot shaped aperture 24 provided in the feed tube 20. Such downward thrust on the upper face of the piston is maintained substantially constant during the downward movement of the piston until the annular rib 35 formed at the upper end of the piston 26 engages with the rib 33 formed in the grooves 32 of the sleeve 31. Until then high pressure fluid is admitted only into the space defined between the external cylindrical face of the upper portion of the piston 26 and the inner face of the casing 11. Once the annular rib 35 formed at the upper end of the piston 26 engages with the rib 33 formed in the grooves 32 of the sleeve 31 high pressure fluid is admitted only into the space defined between the external cylindrical face of the upper portion of the piston 26 and the inner face of the casing 11. Once the annular rib 35 formed at the upper end of the piston 26 disengages from the ribs 33 of the sleeve 31 the first passageway 28 is no longer in communication with the aperture 24 formed in the feed tube 20 and on the piston approaching the end of the stroke the fluid pressure contained in the space between the upper end of the piston and the top sub is exhausted into the internal bore of the piston through the first port 28 and out through the drill bit.

Figure 4:
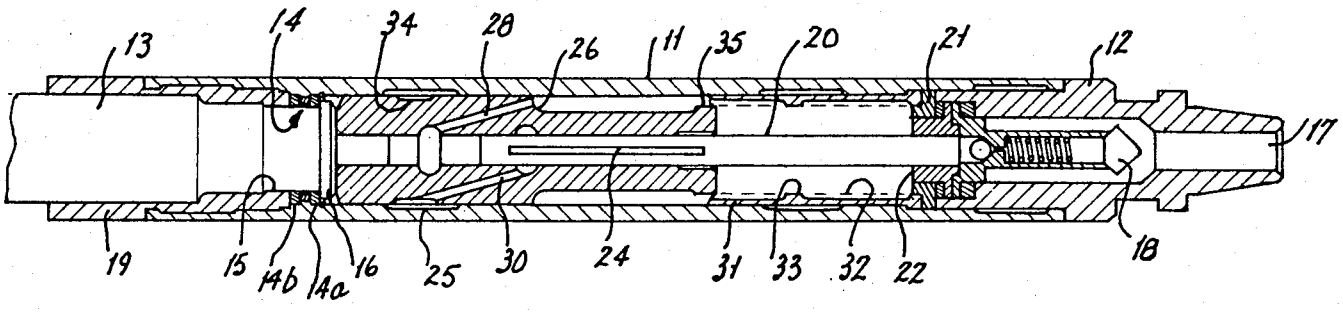
FIG. 4 is a sectional elevation of the fluid operated hammer of FIG. 1 showing the drill bit in the extended position within the casing and the piston in its at rest position.

When the fluid operated hammer is raised from a floor of the bore hole the drill bit 13 is caused to drop in the drill chuck 19 such that the anvil 16 engages with the retaining ring 14. As shown at FIG. 4 when the drill bit 13 is in its lowermost position in the fluid operated hammer, the piston on being driven into engagement with the drill bit in its lowermost position will remain in that position since the second passageway 30 in the piston is sealed from communication with the lower end of the piston 26 and fluid is admitted into the space between the upper end of the piston 26 and the top sub 12 through the counter bored portion 36 of the internal bore of the piston 26 which communicates at its lower end with the aperture 24. In addition the first port 28 is in open communication with the space between the choked end of the feed tube 20 and the drill bit 13 to permit fluid flow between the space formed by the piston counter bored portion 36 and the space between the upper end of the piston and the top sub. As a result fluid from the feed tube is directed through the drill bit to effect "blow-down".

As a result of the embodiment the downward thrust which is exerted on the piston during its operation is effected for a considerable length of its stroke whereby increasing the efficiency of the hammer over those of the prior art. In addition, since the casing is symmetrical about its central transverse plane it may be readily reversed on the fluid hammer on one end of the casing being worn due to its engagement by the piston 26.

Figure 5:
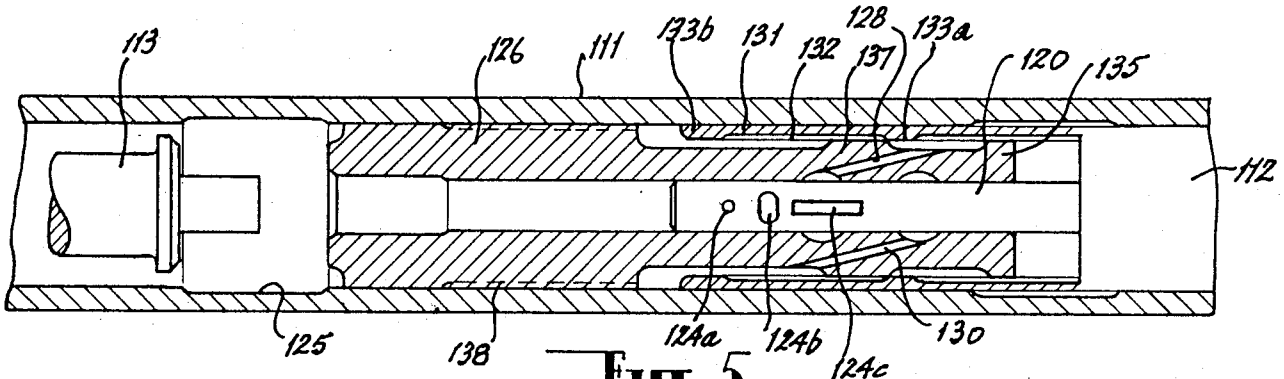
Figure 6:
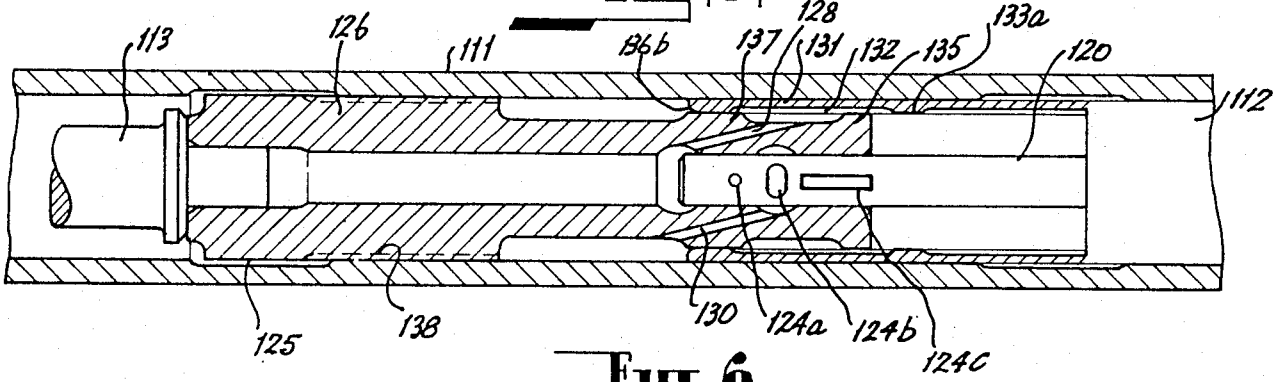
Figure 4:
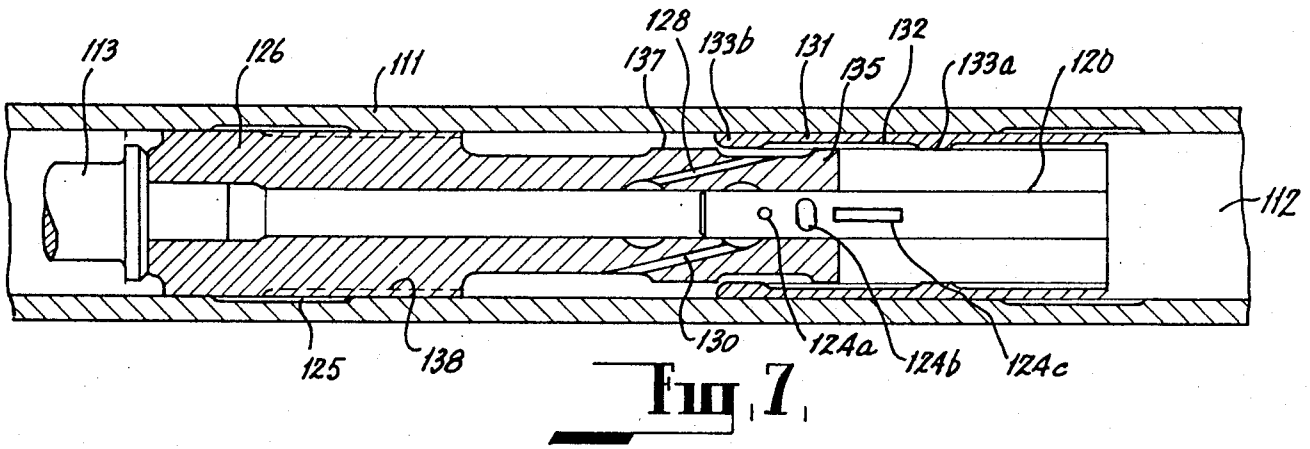

The fluid operated hammer of the second embodiment as shown in FIGS. 5, 6 and 7 comprises a casing 111 having a top sub 112 mounted to one end, a drill chuck (not shown) which supports a drill bit 113 mounted to the other end. The mounting of the top sub 112, the drill chuck and the drill bit 113 is of a similar form to that shown and described in relation to the first embodiment. The casing 111 concentrically supports within itself at its one end a feed tube 120 which extends for a portion of the length of the casing and a piston 126 slidably received within the casing 111 to be movable between the drill bit 113 and the top sub 112 over the feed tube 120. The mounting of the feed tube 120 to the casing can take a similar form to that described in relation to the first embodiment. In addition a cylindrical sleeve 131 is concentrically mounted within the one end of the casing to abut the inner face thereof in substantially concentric opposed relation to the feed tube 120. The piston 126 is formed with a lower portion having an external diameter corresponding substantially to the internal diameter of the casing 111 and an upper portion having an external diameter which is less than the internal diameter of the sleeve 131. The upper end of the piston 126 is formed with an annular rib 135 which has an external diameter corresponding substantially to the internal diameter of the sleeve 131 such that it sealingly and slidably engages the inner face of the sleeve 131. A further annular rib 137 is formed at an intermediate position along the upper portion of the piston 126 and it also has an external diameter corresponding substantially to the internal diameter of the sleeve 131 to slidably and sealingly engage with the inner face of the sleeve 131. The sleeve 131 is formed with a set of elongate grooves 132 which extend the substantially full length of the sleeve 131 but terminate short of the free end of the sleeve 131 to form a sealing rib 133*b* which will sealingly engage with the ribs 137, 135 of the piston. In addition, an intermediate rib 133*a* formed in the grooves 132 of the sleeve 131 and this is intended to sealingly engage with the uppermost rib 135 of the piston when the piston is at an intermediate position during its travel in the hammer. The lower portion of the piston is formed with a series of circumferentially spaced flutes 138 on its external face which extend from the junction between the upper and lower portions of the piston 126 for a portion of a length of the lower portion. The piston has a first passageway 128 extending between the core of the piston and the external face of the piston between the upper annular rib 135 and the intermediate rib 137; and a second passageway 130 between the base of the piston and between the intermediate rib 137 and the lower portion of the piston. The walls of the casing 111 are formed with an annular recess 125 at each end. The upper recess is covered by the sleeve 131. The lower recess communicates with the flutes 138 in the lower end of the piston 126 when the piston 126 is at the lowermost position in the hammer. The feed tube 120 is formed with a set of apertures 124 comprising three apertures spaced longitudinally along the feed tube. The apertures are of different dimensions and are such that the first aperture 124*a* closed to the face end of the feed tube is smaller and is circular, the second aperture 124*b* is larger and is elongate transverse to the feed tube and the third apperture 124*c* the largest and is elongate in the longitudinal axis of the feed tube.

In order that the hammer of the second embodiment maybe more fully understood the operation of the hammer will now be described. When the drill bit 113 is in its raised postion in relation to the drill chuck and the piston is in a lower position in relation to the hammer such that it is in engagement with the raised drill bit 113 (FIG. 6), the second passageway 130 is in communication at its innermost end with the second aperture 124*b* and the flutes 138 in the lower portion of the piston 126 are in communication with the recesses 125 formed in the lower end of the casing 111. This provides for the flow of fluid from the aperture 124*b*, through the second passageway 130, the flutes 138, and the recess 125 into the space below the lower end of the piston 126. As a result an upward thrust is applied to the piston and after a relatively short distance, the flutes 138 in the piston are broken from their communication with the recess 125 while the second passageway 130 enters into communication with the third aperture 124*c*. At that point, the upper annular rib 135 of the piston 126 is in sealing engagement with the intermediate rib 133*a* of the sleeve 131 such that fluid from the second passageway 130 is contained within the space between the external cylindrical face of the upper portion of the piston 126 and the opposed internal faces of the casing 111 and cylindrical sleeve 131. With further upward movement of the piston 126 the first passage 128 begins to sequentially engage with each of the apertures 124*a*, *b* and *c*. In addition, the upper annular rib 135 of the piston disengages from the intermediate rib 133*a* of the cylindrical sleeve to admit the high pressure fluid contained between the cylindrical face of the piston and the casing into the space between the upper end 129 of the piston 126 and the top sub 112 (FIG. 5). The admission of such contained fluid together with further fluid from the apertures 124 decelerates the piston 126 in its upward movement until it stops short of the top sub 112. Further fluid admission produces a downward thrust on the piston 126 which is maintained substantially constant until the upper annular rib 135 of the piston sealingly engages with the intermediate annular rib 133*a* of the cylindrical sleeve 131 to prevent the admission of any further fluid into the space between the upper end of the piston 126 and the top sub 112. When the piston 126 is in a lower position the lower annular rib 133*b* on the cylindrical sleeve 131 is engaged by the intermediate annular rib 137 of the piston 126 to prevent the flow of fluid from the second port 130 into the space between the upper end 129 of the piston and the top sub 112.

When the drill bit is permitted to drop into the "blow-down" position (as shown in FIG. 7), the piston 126 is driven into engagement with the drill bit 113 since, when in its lowermost position in the "blow-down" position the third aperture 124*c* in the feed tube 126 is in communication with the space between the upper end of the piston 126 and the top sub 112 thus providing a substantially constant downward thrust on the piston.

As a result of the second embodiment a thrust is applied to the piston 126 for a considerable portion of its downward movement. In addition the length of the feed tube which is required to admit fluid into the hammer is less than those conventionally in use thus reducing the amount of milling required in production of such feed tube and the degree of accurate milling required on the internal bore of the piston 126. Furthermore, since the casing 111 is symmetrical about its central transverse plane, it may be readily reversed on one end becoming worn.

In addition, when the piston 126 is at its upper position in the casing 111, fluid is not admitted into the space between the cylindrical faces of the piston and casing below the intermediate annular rib 133*a* of the casing to apply further pressure to the annular junction between the upper and lower portions of the piston.

Figure 8:
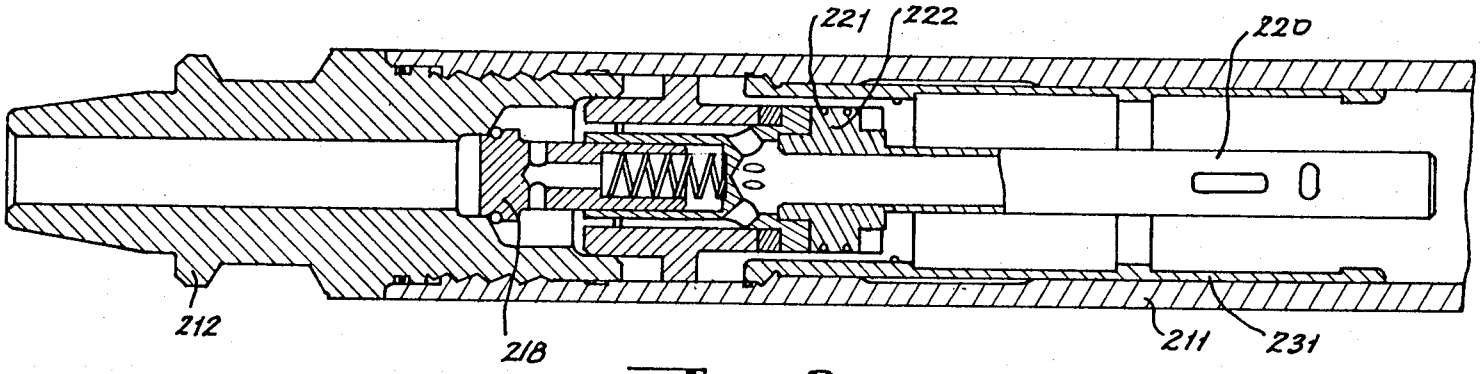
FIG. 8 is an enlarged cross-sectional view of the upper end of a further embodiment of the invention showing another form for mounting the feed tube.

An alternative form of mounting of the feed tube mounting is shown at FIG. 8. The feed tube 220 as shown is formed with a flanged end 222 which is supported in the casing 211 by a spacer and centralising ring 221 which is supported concentrically within the casing and sleeve 231. The flanged end of the feed tube is held in abutting relation with the check valve and distributor housing 218.

Figure 9:
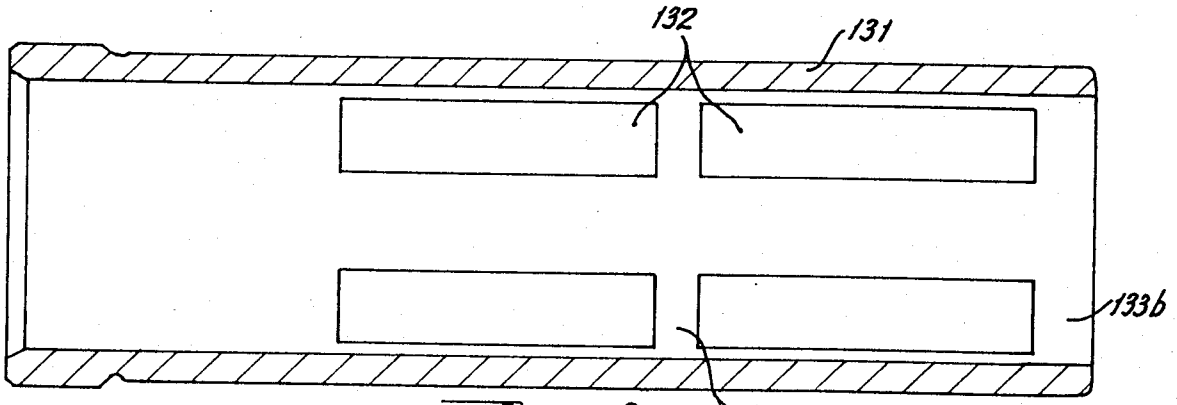
FIG. 9 is an enlarged cross-sectional view of the sleeve 131 of the embodiment of FIGS. 5 through 7.

FIG. 9 is a sectional side elevation of the sleeve 131 of the second embodiment and illustrates the elongate slots 132 formed thereon which are interrupted part way along their length to define an intermediate rib 133*a*. The lower end of the slots 132 terminate short of the lower end of the sleeve 131 to define the lower rib 133*b* therein.

If desired the slots 132 in the sleeve may be replaced by counter-bored sections in the walls of the sleeve.

Figure 10:
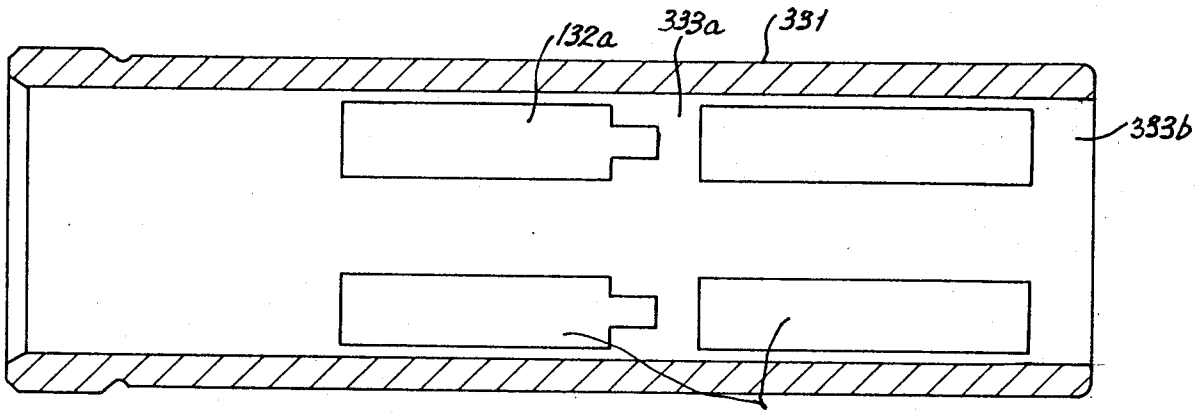
FIG. 10 is an enlarged cross-sectional view, in part similar to FIG. 9, showing another embodiment of the invention.

As shown at FIG. 10, an alternative form of the sleeve 331 of the second embodiment provides for the lower portion of each slot above an intermediate rib 333*a* being configured such that the lower end of an upper slot 332*a* is of a reduced width. As a result the admission of fluid into the space above the upper end of the piston from the space between the cylindrical faces of the piston and casing is more gradual and controlled.

Figure 11:
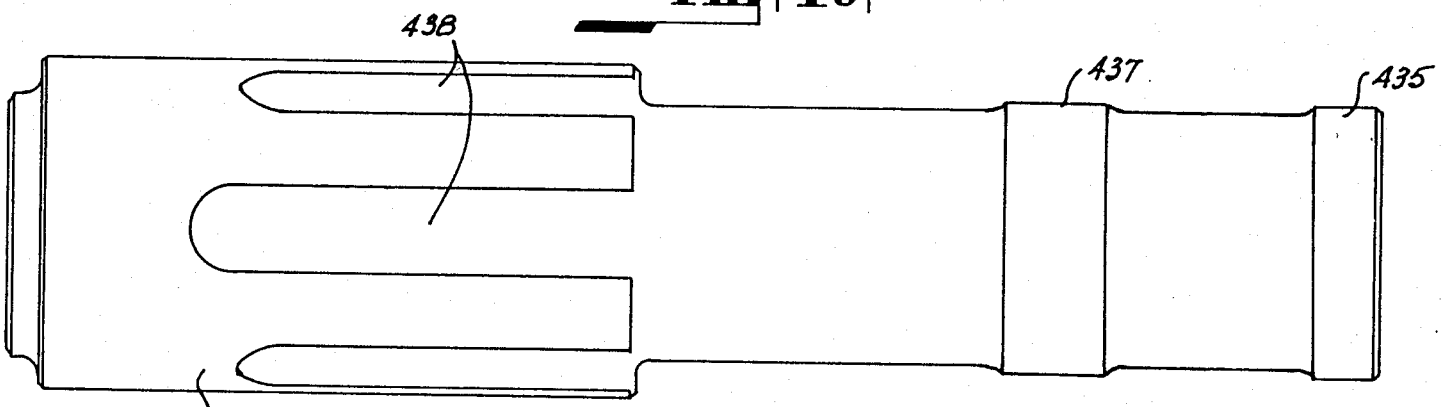
FIG. 11 is an enlarged side elevational view showing a piston constructed in accordance with a still further embodiment of the invention.

FIG. 11 illustrates an alternative form of the piston of the second embodiment. According to the alternative flutes 438 formed in the lower portion of a piston 426 are of different length such that one half of the flutes are longer than the other. By means of the longer flutes the admission of fluid into the space below the piston is maintained for a longer period but in a controlled reduced manner in the early and final stages of such admission. By this means, it is ensured that sufficient upward thrust is applied to the piston to drive it to the top of the casing.

Figure 12:
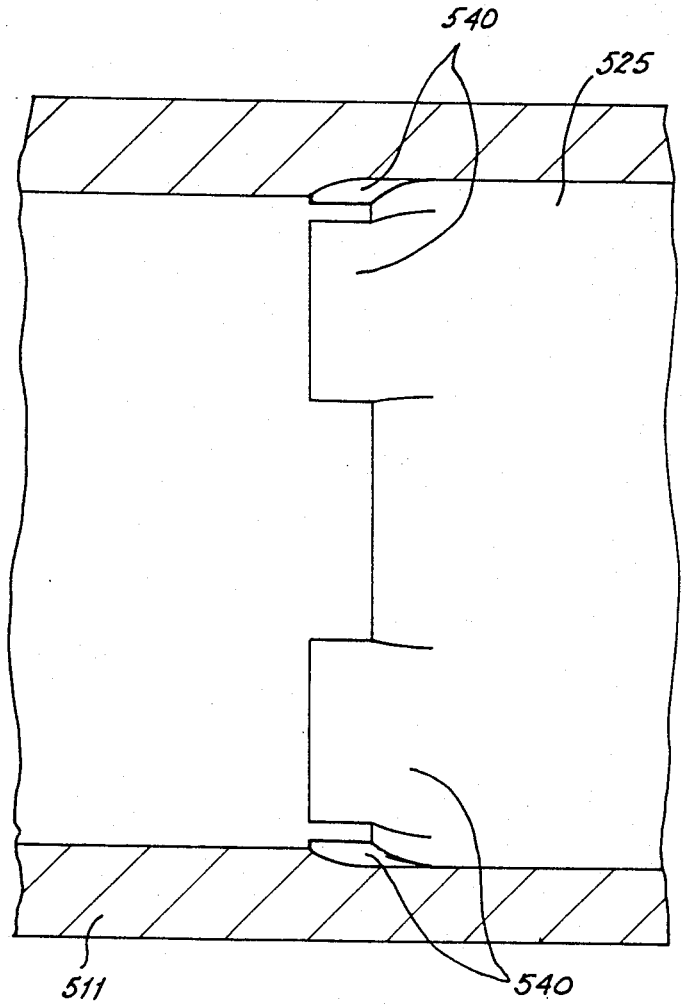
FIG. 12 is an enlarged cross-sectional view of a casing constructed in accordance with a further embodiment of the invention.

A further means of reducing the admission of fluid into the space below the lower end of the piston is shown at FIG. 12 which is a part sectional side elevation of an alternative form of the casing at the upper edge of the recess 525 of the casing 511. The upper edge of a casing 511 is splined as shown to form slots 540 to reduce the area available for fluid communication with the space below the lower end of the piston.

It should be appreciated that the scope of the present invention need not be limited to the particular scope of the two embodiments described above.

I claim:

1. A fluid operated hammer comprising; a casing, a top sub mounted at one end of said casing; a drill bit mounted at the other end of said casing; a feed tube located concentrically within said casing and extending from said one end for a portion of the length of said casing; and a piston slidably mounted in the casing for longitudinal movement between said top sub and said drill bit and having a central bore received over said feed tube; said feed tube being formed with one elongate aperture having its longitudinal axis parallel with the longitudinal axis of the feed tube; the portion of said piston adjacent said top sub being of reduced diameter; a first annular rib formed on said reduced diameter portion of said piston; a second annular rib formed on the internal face of said casing positioned to be slidingly and sealingly engaged by said first rib at an intermediate position of said piston in said casing; to define a reservoir space between the external cylindrical face of said reduced diameter portion of said piston and the internal face of said casing; a first passageway interconnecting said internal bore of said piston and the external face of the reduced diameter portion of said piston wherein when at said intermediate position fluid from said aperture is admitted to said reservoir space and on movement of the piston towards said top sub from said intermediate position said reservoir space opens into the space between the top sub and the adjacent end of said piston; and a second passageway interconnecting said internal bore of said piston with the external face of said piston for providing communication between said aperture and the space between said drill bit and the adjacent end of said piston when said piston is closely adjacent said drill bit.

2. A fluid operated hammer as claimed in claim 1 wherein said casing is formed with said second annular rib located on the opposite side of said first annular rib from said top sub; said first annular rib on said piston is located at the top sub end of the piston; said second annular rib is located at an intermediate position of the reduced diameter portion of said piston; wherein the first passageway opens into the external face of the piston between the first and second ribs thereon and said second passageway opens into the external face of the piston adjacent the second rib but in opposed relation to the first passageway.

3. A fluid operated hammer as claimed in claim 1 or 2 wherein the annular ribs in the casing are formed on the internal face of a sleeve located within the casing.

4. A fluid operated hammer as claimed in claim 3 wherein the unreduced diameter portion of said piston is formed with axial elongate flutes extending partially along the external face of the piston from said reduced diameter position, said flutes communicating with a recess formed in the walls of the casing adjacent the drill bit when the piston is at or adjacent said drill bit.

5. A fluid operated hammer as claimed in claim 4 wherein the flutes are of differing lengths.

6. A fluid operated hammer as claimed in claim 5 wherein the top edge of said recess has a splined configuration.

7. A fluid operated hammer as claimed in claim 6 wherein the internal face of said casing is formed with a first set of elongate flutes spaced circumferentially around the casing adjacent the top sub and rib is of a second set of elongate flutes spaced circumferentially around the casing and spaced at their lower end from the lower end of the feed tube said second set of flutes being spaced from said first set of flutes.

8. A fluid operated hammer as claimed in claim 7 wherein the lower end of the first set of flutes are of a reduced width.

* * * * *

UNITED STATES PATENT AND TRADEMARK OFFICE

CERTIFICATE OF CORRECTION

PATENT NO. : 4,530,407

DATED : July 23, 1985

INVENTOR(S) : Ian G. Rear

It is certified that error appears in the above-identified patent and that said Letters Patent is hereby corrected as shown below:

Column 1, line 44 to Column 2, line 45,
Delete "In one form..." (at column 1, line 44) through "thereon by the bit." (column 2, line 45) and reinsert it at column 3, between lines 42 and 43.

Column 2, line 65 to Column 3, line 18,
Delete "In another form..." (at column 2, line 65) through "between the ends of the piston." (column 3, line 18) and reinsert it at column 3, following the previous insert between lines 42 and 43.

Column 4, line 26, "in" should be --of--.

Column 6, line 35, begin new paragraph with --A first passageway...--.

Column 7, line 1, begin new paragraph with --In addition the first...--.

Column 7, line 18, begin new paragraph with --With further upward...--.

Column 7, line 46, begin new paragraph with --Once the annular...--.

Column 8, line 16, "whereby" should be --thereby--.

Column 8, line 40, begin new paragraph with --The piston 126...--.

Column 8, line 54, begin new paragraph with --The sleeve 131...--.

Column 9, line 5, begin new paragraph with --The walls of...--.

UNITED STATES PATENT AND TRADEMARK OFFICE

CERTIFICATE OF CORRECTION

PATENT NO. : 4,530,407

DATED : July 23, 1985

INVENTOR(S) : Ian G. Rear

It is certified that error appears in the above-identified patent and that said Letters Patent is hereby corrected as shown below:

Column 9, line 11, begin new paragraph with --The feed tube 120...--.

Column 9, line 45, begin new paragraph with --With further upward...--.

Column 9, line 57, begin new paragraph with --Further fluid admission...--.

Column 10, line 66, after "casing" insert --511--.

Column 10, line 67, delete "the" (first occurrence in patent) and insert --a--.

Column 10, line 68, delete "511".

Column 12, line 31, Claim 7, delete "is of" and insert --and--.

Signed and Sealed this

Twenty-seventh Day of September, 1988

*Attest:*

DONALD J. QUIGG

*Attesting Officer* *Commissioner of Patents and Trademarks*